US006783035B2

(12) United States Patent
Garcia et al.

(10) Patent No.: US 6,783,035 B2
(45) Date of Patent: Aug. 31, 2004

(54) FLUID PRODUCT DISPENSER

(75) Inventors: Firmin Garcia, Evreux (FR); Alex Millian, Breteuil-sur-Iton (FR)

(73) Assignee: Valois S.A.S., Le Neubourg (FR)

( * ) Notice: Subject to any disclaimer, the term of this patent is extended or adjusted under 35 U.S.C. 154(b) by 74 days.

(21) Appl. No.: 10/193,275

(22) Filed: Jul. 12, 2002

(65) Prior Publication Data

US 2003/0071071 A1 Apr. 17, 2003

Related U.S. Application Data

(60) Provisional application No. 60/317,961, filed on Sep. 10, 2001, now abandoned.

(30) Foreign Application Priority Data

Jul. 19, 2001 (FR) ..... 01 09667

(51) Int. Cl.[7] ..... B67D 3/00

(52) U.S. Cl. ..... 222/187; 222/209; 222/212; 222/541.5; 222/633

(58) Field of Search ..... 222/187, 209, 222/212, 541.5, 632, 633

(56) References Cited

U.S. PATENT DOCUMENTS 4,275,840 A 6/1981 Staar
4,779,768 A * 10/1988 St. Amand ..... 222/209
5,215,221 A * 6/1993 Dirksing ..... 222/94
5,425,480 A * 6/1995 Rabenau et al. ..... 222/153.07
5,678,736 A * 10/1997 Hansen ..... 222/209
6,343,717 B1 * 2/2002 Zhang et al. ..... 222/209

FOREIGN PATENT DOCUMENTS

FR 2 778 639 11/1999
WO WO 92/17386 A1 10/1992

OTHER PUBLICATIONS

French Search Report.

* cited by examiner

*Primary Examiner*—Joseph A. Kaufman
(74) *Attorney, Agent, or Firm*—Sughrue Mion, PLLC

(57) ABSTRACT

Fluid product dispenser having a fluid product reservoir (13) containing a fluid product, the reservoir (13) and, a distribution orifice (32; 22) through which the fluid product is forced in the form of a spray when the actuation wall (36) is pressed. The reservoir includes a deformable actuation wall (36) that is pressed to reduce the internal volume of the reservoir, a bottom plate (1), an intermediate plate (2) defining an opening (24), and a cover plate (3) including the actuation wall (36), and wherein the opening (24) is formed in the intermediate plate (2) defining the useful volume of the reservoir (13) with the bottom plate (1) and the cover plate (3).

20 Claims, 3 Drawing Sheets

FLUID PRODUCT DISPENSER

CROSS REFERENCE TO RELATED APPLICATION

This application claims the benefit under 35 U.S.C. §119(e) of U.S. provisional patent application Ser. No. 60/317,961, filed Sep. 10, 2001 now abandoned, and priority under 35 U.S.C. §119(a)–(d) of French patent application No. FR-01.09667, filed Jul. 19, 2001.

TECHNICAL FIELD

This invention relates to a fluid product dispenser comprising a fluid product reservoir containing a fluid product and advantageously adapted to also contain a gas such as air, the said reservoir comprising a deformable actuation wall on which the user presses to reduce the internal volume in the reservoir, and a distribution orifice through which the fluid product is forced in the form of a spray by pressing on the actuation wall.

BACKGROUND OF THE INVENTION

A dispenser of this type is already known in document FR 2 791 645. In this document, the reservoir is formed starting from two deformable flexible sheets welded together around their peripheries and holding a plastic part between them defining an outlet orifice and supporting an element made of a porous material that extends inside the reservoir to become full of the fluid product. The two flexible sheets each forms one deformable actuation wall. These two deformable actuation walls are activated by separating one from the other by elastic means in the form of a spring that can be placed inside the reservoir, or outside the reservoir. Therefore it is possible to move the two walls closer together by pressing the two towards each other against the action of the spring. This document incorporates a very attractive characteristic that may also be used within the framework of this invention. In fact, the distribution orifice is closed off by a removable closing device, while the spring is compressed to its maximum state such that the reservoir defines a minimum volume. This minimizes the thickness of the dispenser so that it can be inserted in magazines or brochures as a free sample in the form of a genuine dispenser spray.

However, due to the fact that the reservoir is formed from two flexible deformable sheets acted upon by a spring, it is difficult to guarantee that the dispenser is perfectly aesthetic. The spring tends to deform the flexible sheets when the removable closing device is in place, because it is compressed to its maximum. In order to overcome these aesthetic problems, it is preferable to coat or surround the dispenser inside an outer skin that improves its aesthetics.

BRIEF SUMMARY OF THE INVENTION

The purpose of this invention is to overcome this disadvantage with prior art by defining a fluid product dispenser for which the aesthetics is not affected by the nature of the material used to make the reservoir, and more particularly its deformable actuation walls.

In order to achieve this purpose, this invention proposes that the reservoir should include a bottom plate, an intermediate plate defining an opening and a cover plate in which actuation wall is included, the opening formed in the intermediate plate defining the useful volume of the reservoir with the bottom plate and the cover plate. Unlike what is described in the document according to prior art mentioned above, the reservoir is no longer formed simply from two flexible sheets welded together to define an internal volume acting as a reservoir, but on the contrary the useful volume of the reservoir is formed by the opening in the intermediate plate that is completed by fixing two other plates, namely the bottom and the cover respectively. The intermediate plate is rigid, or almost rigid and the bottom and cover-plates may also be rigid, or they may be flexible. Preferably, the bottom plate is rigid or almost rigid, and the cover plate may possibly be formed from a deformable or quasi-deformable flexible sheet.

Advantageously, the wall thickness of each plate is less than about 1 mm. Preferably, the intermediate plate is the thickest plate, so that it can define a sufficiently large useful reservoir size. The opening in the intermediate plate is in the form of a simple or complex shaped cut-out. This cut-out defines a very low height cylinder, considering that the thickness of the intermediate plate is only about one millimeter. The bottom and cover plates simply close this cylinder in order to obtain a cylindrical reservoir.

The actuation wall is included in the cover plate, but it would also be possible to integrate this actuation plate in the bottom plate. It would also be possible to use two actuation walls, one in each bottom plate and cover plate.

Advantageously, the actuation wall is formed in a single piece with the cover plate. However preferably, the actuation wall is added into the cover plate which is provided with a window in which an actuation device forming the actuation wall can be fitted. With this second embodiment, it is possible to use bottom, intermediate and cover plates by punching simple plates and making the actuation device by moulding a deformable plastic material.

According to one advantageous embodiment, the actuation wall comprises elastic means that give it a shape memory that brings it back into the rest position corresponding to the maximum volume of the reservoir. Preferably, the elastic means comprise a flexible strip embedded in the thickness of the actuation wall. Thus, the elastic means are not in contact with the fluid product contained in the reservoir such that there is no possible interaction between the flexible strip and the fluid product. Furthermore, the flexible strip is not visible from the outside, which improves the aesthetics of the actuation wall. Furthermore, the flexible strip is perfectly protected inside the thickness of the actuation wall.

According to another characteristic, the reservoir contains a part made of porous material capable of retaining the fluid product.

According to another aspect of the invention, the distribution orifice is formed in the cover plate. As a variant, the distribution orifice is formed in the intermediate plate.

Furthermore, the distribution orifice may be provided with a removable sealed closing device closing off the orifice before the first use and that can be repositioned on the orifice after use.

According to another interesting characteristic, the closing device is initially welded around the orifice and also comprises an adhesive that can be repositioned and is capable of bonding repeatedly around the orifice. The closing device thus assures the user that he or she is the first to use it because it is initially welded, and also provides an appropriate sealed closing means such that the dispenser can be reused later without a risk of leakage.

According to another aspect, the bottom, intermediate and cover plates are stacked and fixed to each other, advantageously by welding or gluing around the opening formed by the intermediate plate.

As in the above-mentioned document according to prior art, the actuation wall may be flattened before the first use such that the reservoir contains practically nothing other than the fluid product, and the thickness of the dispenser is then less than or equal to about 2 mm.

BRIEF DESCRIPTION OF THE DRAWINGS

The invention will be described more fully with reference to the attached drawings given as non-limitative examples of two embodiments of the invention.

In the figures.

DETAILED DESCRIPTION

Figure 1:
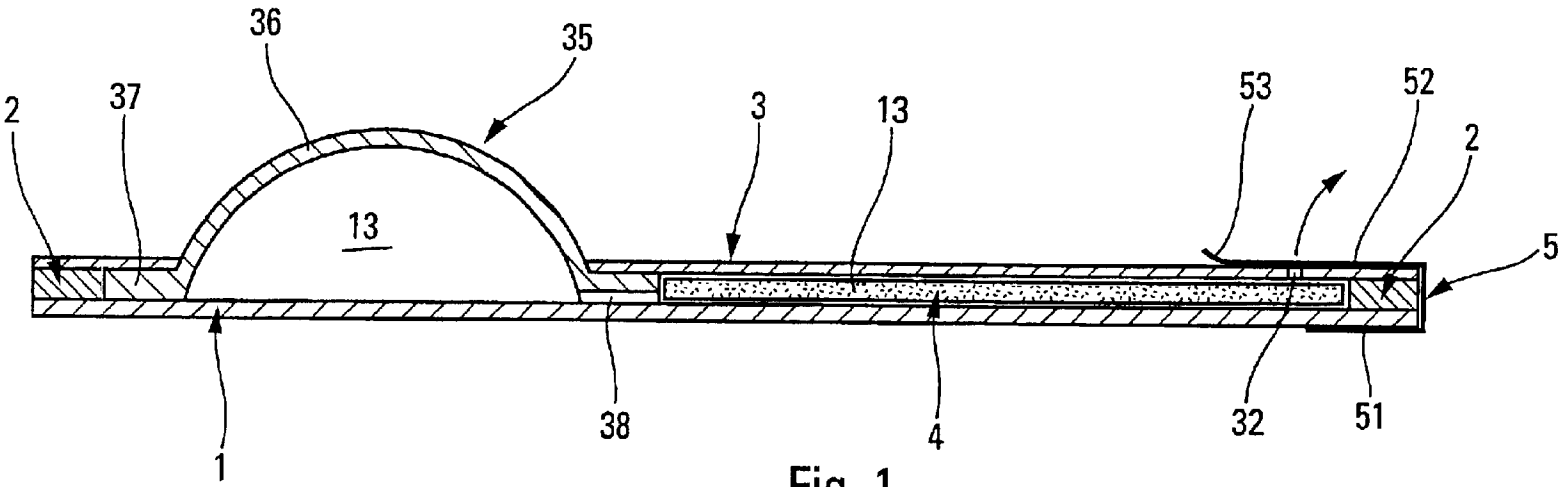
FIG. 1 is a vertical cross-sectional view through a dispenser according to a first embodiment of the invention.

In both embodiments, the dispenser comprises a bottom plate 1, an intermediate plate 2, a cover plate 3, an actuation wall 36 and a distribution orifice 32; 22. The plates 1, 2, 3 and the actuation wall 36 together define a fluid product reservoir 13. The dispenser also comprises a part 4 made of porous material contained in the reservoir 13. Optionally, the dispenser may be provided with a removable sealed closing device 5 that covers the distribution orifice 22; 32 in a sealed manner.

Figure 2:
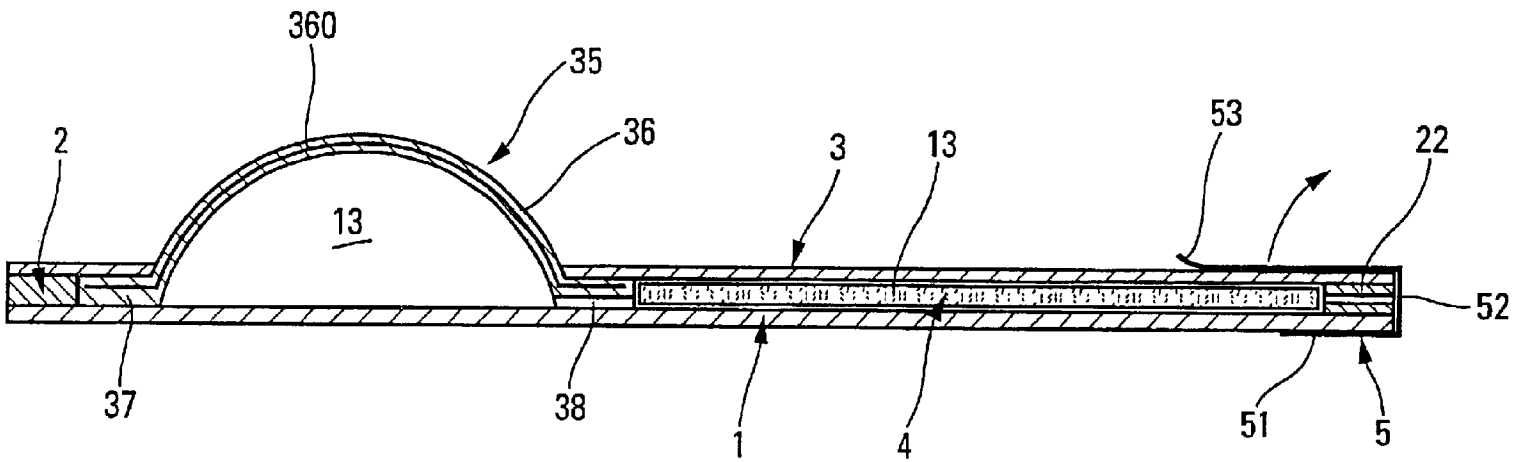
FIG. 2 is a view similar to the view in FIG. 1 for a dispenser according to a second embodiment of the invention.

The only difference between the embodiments in FIGS. 1 and 2 are the position of the distribution orifice, namely at the cover plate 3 for the distribution orifice 32 in FIG. 1, and at the intermediate plate 2 for the distribution orifice 22 in FIG. 2. Obviously, other embodiments could be considered, for example in which the distribution orifice is located in the bottom plate 1. In any case, it would be advantageous to see the distribution orifice together with the actuation wall 36.

Figure 3:
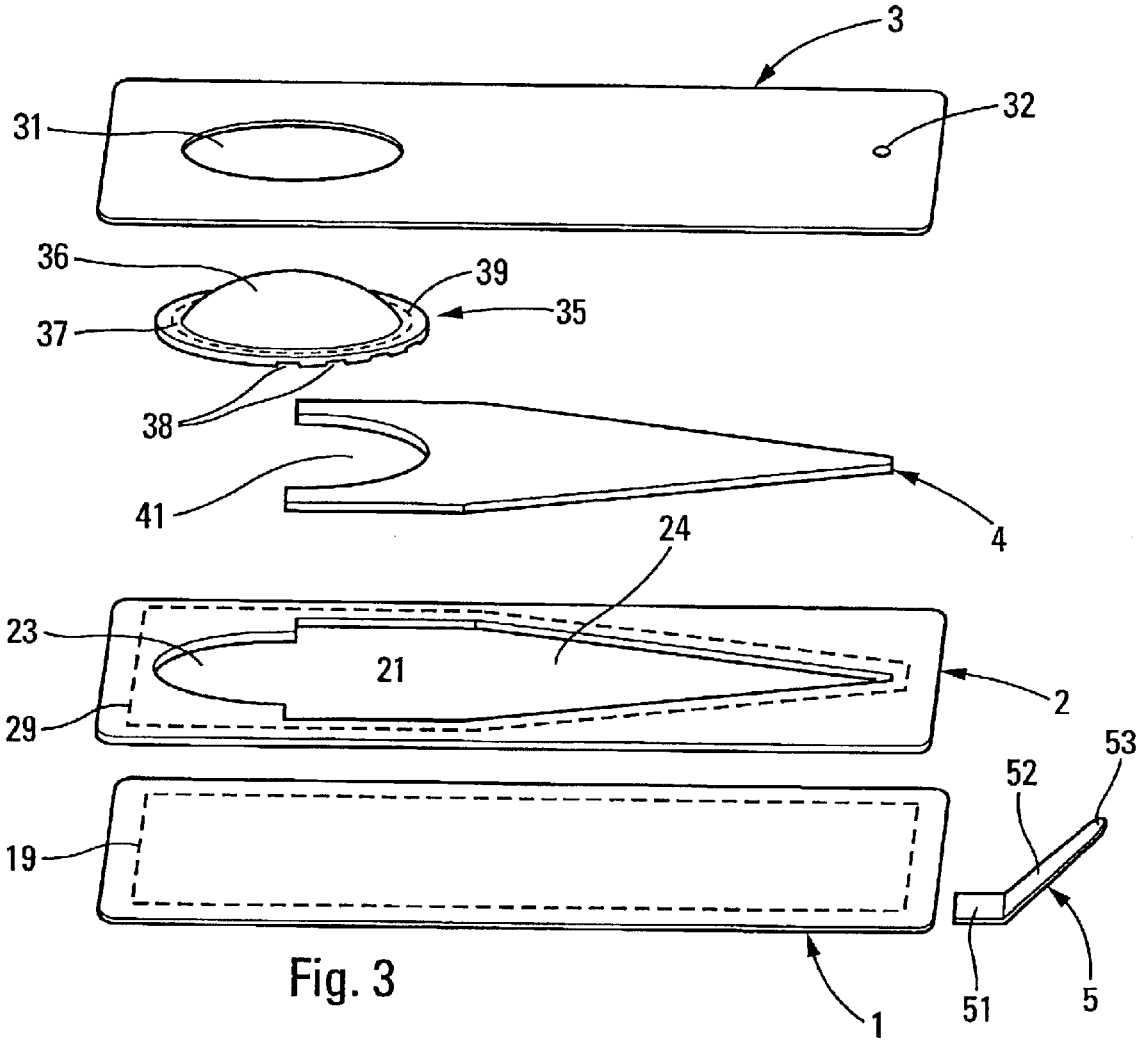
FIG. 3 is an exploded perspective view of the dispenser in FIG. 1.

FIG. 3 shows the six component parts of the dispenser according to the embodiment in FIG. 1, since the distribution orifice is made in the cover plate.

Plates 1, 2 and 3 are preferably plates made of a relatively rigid plastic material. However, the cover plate 3 may be a simple flexible sheet that is actually used as a cover to fill in the reservoir 13 formed by the intermediate plate 2 and the bottom plate 1. It would also be possible for the bottom plate 1 to be made from a deformable flexible sheet. Even the intermediate plate 2 may be deformable. However, it is preferable that at least one of the three plates should be rigid or almost rigid so that the dispenser has a certain stiffness. In practice, the bottom plate 1 and the intermediate plate 2 are relatively rigid plates, and the cover plate 3 may be an almost rigid plate or a deformable flexible sheet.

According to another characteristic, the accumulated thickness of the dispenser is approximately equal to or less than 2 mm so that it can be inserted in magazines or brochures. This requires that the wall thickness of each plate should be less than or equal to about 1 mm. In practice, the intermediate plate 2 is the thickest, while the bottom plate 1 and the cover plate 3 may be thinner.

Now with reference particularly to FIG. 3, it can be seen that the bottom plate 1 is a simple very flat and solid rectangular element since there are no cut-outs or openings in it. For example, the bottom plate 1 may be the size of a conventional credit card with a thickness of less than about 1 mm. It can be made from any appropriate material, such as plastic, paper, metal, or a combination of plastic, paper and metal. Preferably, the bottom plate 1 is made by punching a large and almost rigid plastic material, for practical and cost reasons.

Advantageously, the intermediate plate 2 has the same dimensions as the bottom plate 1; however, it may be thicker. The intermediate plate 2 may also be made by punching a large plate of almost rigid plastic material. It would also be possible to use other materials like the materials used for the bottom plate 1. The intermediate plate 2 is cut-out to form an opening 21 that in this case can be broken into two parts 23 and 24 that work together to form a single opening. In the figures, the opening 21 does not extend to an outer side edge of the plate, but this is possible. The opening would thus be in form of a notch extending from an edge of the plate.

Figure 4:
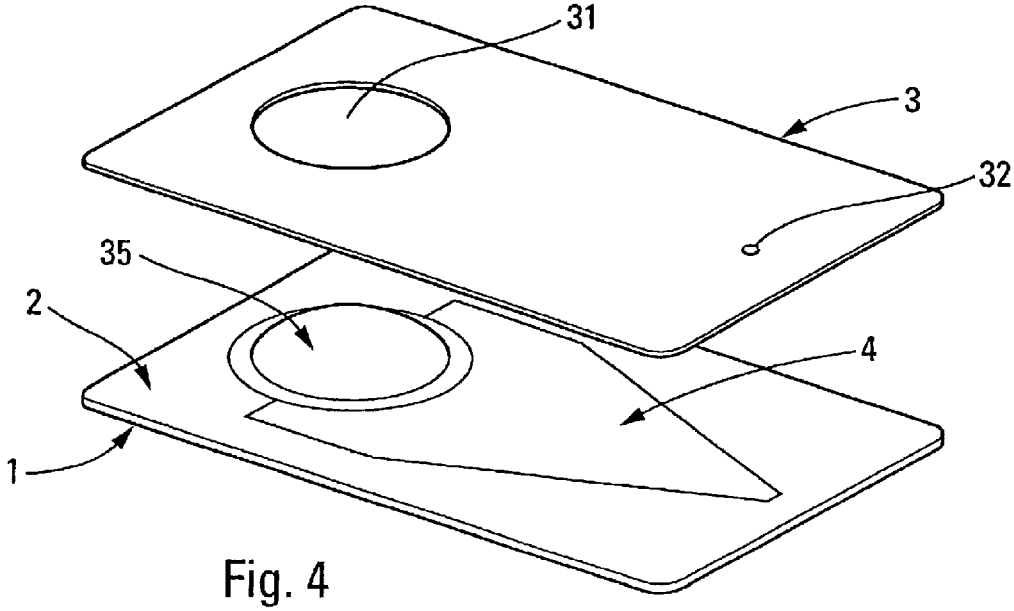
FIG. 4 is an exploded perspective view of the dispenser in FIGS. 1 and 3 during assembly.

Advantageously, the cover plate 3 has the same dimensions as the bottom plate 1 and the intermediate plate 2. However, it may be thinner than the intermediate plate 2 and even thinner than the bottom plate 1 since it can be made from a relatively flexible deformable sheet. However, an almost rigid plate would be preferable. For example, it would be possible to make the bottom plate 1 and the cover plate 3 from the same sheet of material. In the embodiment shown in FIGS. 1, 3 and 4, the cover plate 3 is also formed with a distribution orifice 32 that passes through the cover plate. In the embodiment shown in FIG. 2, the distribution orifice 22 is formed transversely through the intermediate plate 2; the distribution orifice 22 that defines an exit channel extends from the opening 21 as far as the outside edge of the intermediate plate, as can be seen in FIG. 2.

Figure 5:
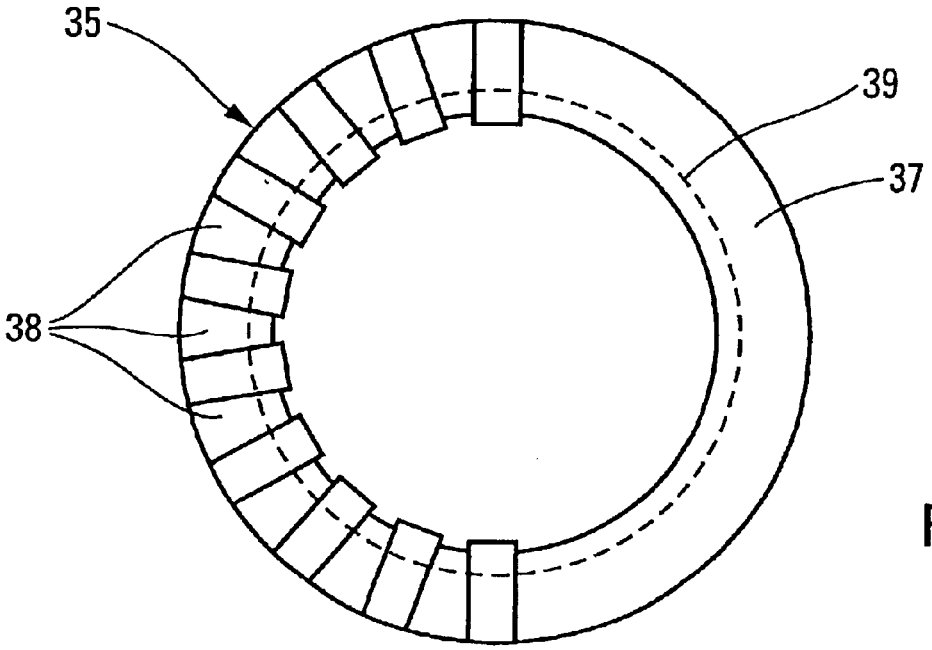
FIG. 5 is a bottom view of the actuation device used in the dispenser in FIG. 1.
Figure 6:
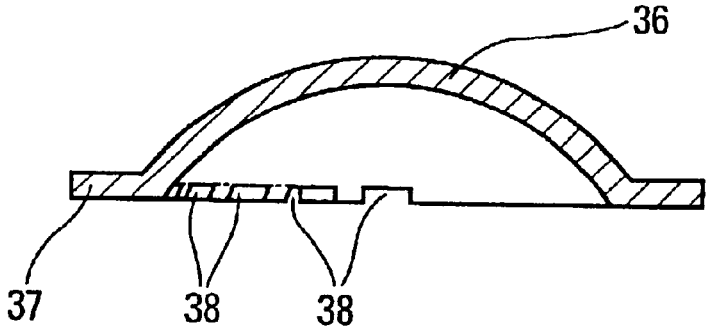
FIG. 6 is a vertical cross-sectional view through the actuation device in FIG. 5.

In both embodiments, the deformable actuation wall 36 is formed by an actuation device 35 that forms a dome defining the actuation wall 36. This dome fits into a reception housing 31 formed in the cover plate 3. In this case the actuation device 35 is a separate part added into the reception housing 31 formed in the cover plate 3. However, it could be imagined that the actuation wall 36 could be formed in a single piece with the cover plate 3 in order to close the reception housing 31. This housing may be made by using a thinner wall for the actuation wall 36. However in this case, it will no longer be possible to make the cover plate 3 by punching a large flat plastic plate. It would then be necessary to make the cover plate 3 using an injection and moulding technique. It is preferred to form the actuation wall using a separate actuation device for cost reasons and for practical reasons so that the cover plate can be made simply by punching. Thus, the actuation device 35 defines this actuation dome 36 around the periphery of which there is a collar 37 that fits under the edge of the reception housing 31. This collar 37 also fits into the opening part 23 of the opening 21 formed in the intermediate plate 2. The lower surface of the collar 37 bears on the bottom plate 1. As can be seen with reference to FIGS. 5 and 6, the lower surface of the collar 37 is formed with several passage grooves 38 such that a passage is created even when the collar 37 is pressed on the bottom plate 1.

Figure 7:
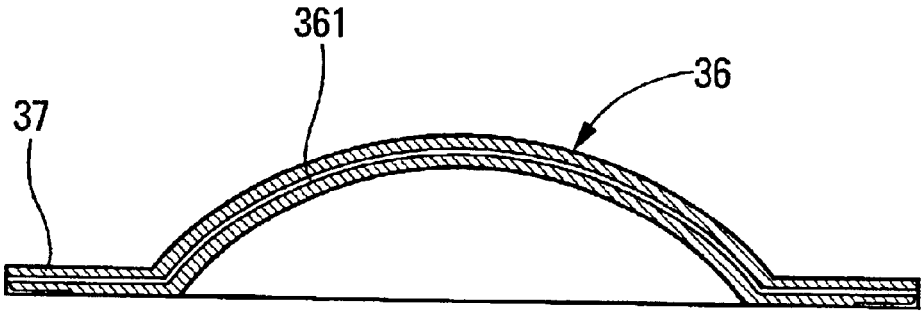
FIG. 7 is a vertical cross-sectional view through the actuation device in FIG. 2.

The actuation wall 36 is provided with elastic means that give it a shape memory bringing it back into a convex rest position. The volume defined below the actuation wall is maximum in this position. When the actuation wall is pressed, the wall is pushed in such that the volume defined below it is very much reduced. When the pressure on the actuation wall is released, it returns to its initial convex shape, under the action of the elastic means. In the embodiment shown in FIG. 1 that corresponds to FIGS. 5 and 6, these elastic means are provided directly by the material from which the actuation device is made, and that has elastic shape memory qualities. A thermoplastic material is perfectly suitable. On the other hand, in the embodiment in FIG. 2 that corresponds to FIG. 7, these elastic means may be complemented by a flexible strip 361 that is advantageously embedded in the thickness of the actuation wall 36. The flexible strip may even extend into the collar 37 as can be seen in FIG. 7. Since the flexible strip 361 is embedded inside the actuation wall 36, it cannot come into contact with the fluid product to be distributed. Furthermore, it is also protected from the outside. This embedded flexible strip 361 provides or improves elastic shape memory characteristics of the actuation wall 36. Note that this characteristic may be used in any elastically deformable actuation wall independently of the fact that the dispenser is composed of three superposed plates. Therefore, this characteristic can be protected independently.

Finally, the part 4 made of porous material may be made from any material that can be impregnated with a fluid product. The shape of the part 4 made of porous material is advantageously adapted to the shape of the opening part 24 of the opening 21 formed through the intermediate plate 2. Furthermore, the part 4 made of a porous material is formed with a recess 41 into which the collar 37 of the actuation device 35 fits. This can be seen clearly in FIG. 4, where the intermediate plate 2 installed in contact on the bottom plate 1 can be seen with the part 4 made of porous material fitted into the opening part 24 and the actuation device 35 housed in the opening part 23 and in the recess 41.

The removable sealed closing device 5 is in the form of a flexible edge strip that defines a permanent attachment part 51 fixed to the lower face of the bottom plate 1, a closing part 52 covering the distribution orifice 22; 32 in a sealed manner, and a gripping tab 53 through which the user can pull the edge strip 5 in order to pull off the closing part 52 of the distribution orifice. Advantageously, the closing part 52 is initially welded around the distribution orifice to isolate it in a sealed manner. Furthermore, the closing part 52 is provided with a repositionable adhesive in order to close off the distribution orifice later, after use. Thus, the dispenser can be used several times without any risk of leakage caused by the product flowing through the distribution orifice. Note that this characteristic, namely a heat sealed adhesive and repositionable closing tab, may be used on any dispenser with a distribution orifice, independently of the embodiment with three stacked plates superposed on each other described here. Therefore, this characteristic can be protected independently.

According to the invention, the intermediate plate 2 with its opening 21 is fixed on the bottom plate 1 along a sealed attachment line 19. Advantageously, the heat sealing technique is used for attachment of the intermediate plate 2 on the bottom plate 1. The bottom plate 1 and the intermediate plate 2 then together define an internal volume in which the peripheral walls are formed by the edges of the opening 21 and the bottom of the bottom plate 1. The part 4 made of porous material is located in the opening 21 in part 24. Similarly, the actuation device 35 is placed in the opening 24 in part 23. The actuation device 35 is advantageously fixed by welding to the bottom plate 1 along an attachment line 39 that extends around the collar 37. At this stage, the configuration is as shown in the FIG. 4. Finally, the cover plate 3 is fixed in a sealed manner on the intermediate plate 2 along a sealed attachment line 29 that can be made by heat sealing. The cover plate 3 being put into position on the intermediate plate 2 makes the dome-shaped actuation wall 36 engage with the actuation device 35 through the reception housing 31 formed in the cover plate 3. The cover plate 3 is also welded to the actuation device 35 at the attachment line 39.

The stack of three plates 1, 2 and 3 and their sealed mutual attachment with the actuation device 35 defines a reservoir 13 that extends around the entire extent of the opening 21 of the intermediate plate 2, in other words at the actuation wall 36 and at the part 4 made of porous material. As can be seen in FIGS. 1 and 2, the part of the reservoir defined at the actuation wall 36 is in communication with the part of the reservoir defined in the part 4 made of porous material by passage grooves 38 formed on the underside of the collar 37 of the actuation device 35. Note that the part 4 made of porous material is located between the actuation wall 36 and the distribution orifice 22 or 32. Consequently, compressing the actuation wall 36 reduces the internal volume of the reservoir 13 and forces the fluid product to be distributed by spraying at the distribution orifice through the part 4 made of porous material. Preferably, the reservoir 13 contains a small quantity of a fluid product and a gas, for example air. For example, the fluid product may be contained entirely inside the part 4 made of a porous material, whereas the part of the reservoir defined under the actuation wall 36 may contain air only. Pressing on the actuation wall 36 will drive out the air contained in this part of the reservoir through the passage grooves 38 and then through the part 4 made of porous material that is impregnated with fluid product. The two-phase air and fluid product mix is then distributed through the distribution orifice in the form of a sprayed two-phase jet.

According to another characteristic of the invention, the actuation wall 36 is completely pushed in to bring the wall 36 into contact with the bottom plate 1 before use. Closing the distribution orifice using the closing device 5 prevents penetration of air inside the reservoir 13 that contains only, or almost only, the fluid product. Thus, the thickness of the dispenser in its storage condition before use corresponds to the accumulated thickness of the three plates (bottom, intermediate and cover) which is advantageously less than about 2 mm. As soon as the removable closing device is removed, air can penetrate into the reservoir and the elastic means in the actuation wall 36 bring it into the convex rest position shown in FIGS. 1 and 2. After use by pushing the actuation wall 36 inwards, the closing device can be put back into its position using its appropriate adhesive, as shown in FIGS. 1 and 2.

In another embodiment, the cover plate may be interconnected or attached to the bottom plate in some zones. This may namely be the case when the opening of the intermediate plate opens to an outer edge of the plate. At this area, the cover and bottom plates may be welded together.

According to the invention, the fluid product dispenser has good mechanical resistance, a flat and smooth aesthetic appearance, is reliable in operation and is leak resistant.

What is claimed is:

1. Fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the actuation wall (36) is added into the cover plate (3) that contains a reception window (31) to contain an actuation device (35) forming the actuation wall (36).

2. Dispenser according to claim 1, in which the wall thickness of each plate is less than about 1 mm.

3. Dispenser according to claim 1, in which the distribution orifice (22) is formed in the intermediate plate (2).

4. Dispenser according to claim 1, in which the bottom plate (1), the intermediate plate (2) and the cover plate (3) are stacked and fixed to each other, advantageously by welding or gluing, around the opening (24) formed by the intermediate plate (2).

5. Dispenser according to claim 1, in which at least one of the plate is flexible.

6. Dispenser according to claim 1, in which the opening (24) in the intermediate plate (2) is open on an outer edge of the plate.

7. Dispenser according to claim 1, in which the bottom and cover plate are partially interconnected.

8. A fluid product dispenser comprising:

a fluid product reservoir (13) containing a fluid product, the reservoir (13) comprising a deformable actuation wall (36) that pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the actuation wall (36) comprises elastic means (360) conferring a shape memory on it to bring it back into its rest position corresponding to the maximum volume of the reservoir.

9. Dispenser according to claim 8, in which the actuation wall (36) is formed in a single piece with the cover plate (3).

10. Dispenser according to claim 8, in which the elastic means comprise a flexible strip (36) embedded in the thickness of the actuation wall (36).

11. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the reservoir (13) contains a part (4) of porous material capable of retaining the fluid product.

12. The dispenser according to claim 11, wherein the actuation wall (36) is formed in a single piece with the cover plate (3).

13. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the distribution orifice (22) is formed in the cover plate (3).

14. The dispenser according to claim 13, wherein the actuation wall (36) is formed in a single piece with the cover plate (3).

15. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the distribution orifice (32; 22) is provided with a sealed removable closing device (5) closing off the orifice before the first use and configured to be repositioned on the orifice after use; and wherein the closing device (5) is initially fixed around the orifice and also comprises an adhesive that can be repositioned and is capable of bonding repeatedly around the orifice.

16. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the distribution orifice (32; 22) is provided with a sealed removable closing device (5) closing off the orifice before the first use and configured to be repositioned on the orifice after use; and wherein the actuation wall (36) is flattened before the first use such that the reservoir contains almost only the fluid product, the dispenser then being less than or equal to about 2 mm thick.

17. The dispenser according to claim 16, wherein the actuation wall (36) is formed in a single piece with the cover plate (3).

18. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the distribution orifice (32; 22) is provided with a sealed removable closing device (5) closing off the orifice before the first use and configured to be repositioned on the orifice after use; and wherein the reservoir (13) also contains a gas, such as air, so as a mixing of fluid product and gas is dispensed through the orifice.

19. The dispenser according to claim 18, wherein the actuation wall (36) is formed in a single piece with the cover plate (3).

20. A fluid product dispenser comprising:

a fluid product reservoir (13) containing a fluid product, the reservoir (13) comprising a deformable actuation wall (36) that is pressed to reduce the internal volume of the reservoir, and a distribution orifice (32; 22) through which the fluid product is forced in the form of a spray when the actuation wall (36) is pressed, and wherein the reservoir comprises:

a bottom plate (1), an intermediate plate (2) defining an opening (24), and a cover plate (3) including the actuation wall (36), the opening (24) formed in the intermediate plate (2) defining the useful volume of the reservoir (13) with the bottom plate (1) and the cover plate (3); and wherein the distribution orifice (32; 22) is provided with a sealed removable closing device (5) closing off the orifice before the first use and configured to be repositioned on the orifice after use; and wherein the intermediate plate is punched.

* * * * *